United States Patent [19]

MacKissinger, Jr. et al.

[11] Patent Number: 4,611,484

[45] Date of Patent: Sep. 16, 1986

[54] QUICK CHANGE MOUNTING PLATE

[75] Inventors: William M. Kissinger, Jr., Carlisle; Howard C. Phillips, Harrisburg, both of Pa.

[73] Assignee: AMP Incorporated, Harrisburg, Pa.

[21] Appl. No.: 680,210

[22] Filed: Dec. 10, 1984

[51] Int. Cl.[4] ..... B21D 37/04

[52] U.S. Cl. ..... 72/481; 83/698; 269/309

[58] Field of Search ..... 269/20, 309-311; 72/481; 83/698-700; 409/219, 220; 29/56.6

[56] References Cited

U.S. PATENT DOCUMENTS

| | | | |
|---|---|---|---|
| 3,184,950 | 5/1965 | Sitz | 72/331 |
| 3,229,791 | 1/1966 | Soman | 72/462 |
| 3,327,575 | 6/1967 | Duffee et al. | 83/698 |
| 3,343,398 | 9/1967 | Kerns | 72/456 |
| 3,982,458 | 9/1976 | Terasaka | 83/698 |
| 4,393,685 | 7/1983 | Sakamura | 83/698 |

FOREIGN PATENT DOCUMENTS 1194227 8/1961 Fed. Rep. of Germany .

*Primary Examiner*—Frederick R. Schmidt
*Assistant Examiner*—Judy J. Hartman
*Attorney, Agent, or Firm*—Thomas G. Terrel

[57] ABSTRACT

A quick change mounting plate for securing an end fed or a side fed electrical terminal applicator, alternatively, to a press for operating the applicator, is provided with latches for locking the base plate of the respective applicator to the mounting plate. Each latch is movable between a raised latching position and a lowered position in which the latch does not interrupt the surface of the mounting plate, upon which surface the respective base plate is to be supported. The latches, one of which is positioned substantially centrally of said surface, are located to engage, in their raised positions, the edes of the base plate of the respective applicator. The latches which are not to be used for this purpose in respect of a particular base plate are kept in their lowered positions so that surface to surface contact between such base plate and the mounting plate can be achieved.

6 Claims, 9 Drawing Figures

38
39
50
48
48
40
41
36
44
48
42
90
92
95
76
82
64
70
116
78
84
66
120
86
152
154
64
96
64
88
94
80
95
126
12
72
122
134
68
142
81
14

56
62
58
58
62
53
54
34
58
52
90
64
116
92
82
76
84
70
95
78
86
154
94
64
64
120
96
126
124
80
148
112
60
72
12
74
68
81
142
134
14

QUICK CHANGE MOUNTING PLATE

This invention relates to a quick change mounting plate adapted to be secured to a press bed, and particularly but not exclusively, concerns such a mounting plate for applicators for applying electrical terminals to wires.

Such applicators are provided with means for feeding electrical terminals in strip form, one by one onto a crimping anvil beneath a crimping die, or dies, mounted on a ram of the applicator. The ram is operated by a crimping press upon which the applicator is mounted, so as to crimp each terminal, when it is on the anvil, to a wire end inserted between the die and the anvil, when the ram is in a top dead center position.

Such applicators are of two kinds, namely side fed applicators and end fed applicators. Side fed applicators are adapted for use with strip form electrical terminals connected together by at least one carrier strip in parallel relationship, end fed terminal applicators being adapted for use with strip form terminals that are connected together by means of intermediate metal slugs, in end to end relationship. Customarily, each such applicator has a base plate which is arranged to be secured by means of screws to an applicator mounting plate on the bed of the press.

The base plates of side fed and end fed applicators are of different profile, since they are adapted to be secured to the mounting plate on the press, in different orientations. A side fed applicator, when mounted to the press is fed from one side thereof, an end fed applicator when mounted to the press being fed from the opposite side thereof. In each case, the wire ends are fed to the applicator from the forward side of the press.

When, for example, a side fed applicator has been mounted on the press, and a production run using side fed terminals has been completed, it may then be required to carry out a further production run using an end fed applicator. In this case, the side fed applicator base plate must be unscrewed from the mounting plate on the press and the base plate of an end feed applicator screwed thereto in its place. Such a change over operation is unduly time consuming.

Although an electrical terminal crimping press which is capable of receiving either a side fed, or an end fed, applicator is disclosed in U.S. Pat. No. 3,343,398, that reference discloses no means by which one of these applicators can rapidly be exchanged for another.

The invention is intended to provide a mounting plate for attachment to a press bed, which enables an apparatus of one kind to be operated by the press, to be rapidly replaced by an apparatus of another kind to be operated by the press.

To this end, the mounting plate is provided with latches, for engaging the base plates of the respective apparatus, each of these latches being movable between a raised, latching position and a lowered position in which the latch does not interrupt the surface of the mounting plate, upon which the base plate is to be supported. The latches are positioned to engage, in their raised positions, the edges of the base plates of respective apparatus. Thus those latches which are not to be used for this purpose in respect of a particular base plate can be kept in their lowered positions so that they do not prevent surface to surface contact between the base plate and the mounting plate, from being achieved.

The latches can be selectively raised and lowered to enable one apparatus to be detached from the mounting plate and replaced by another in a matter of seconds.

For a better understanding of the invention and to show how it may be carried into effect, an embodiment thereof will now be described by way of example with reference to the accompanying drawings in which.

Figure 5:
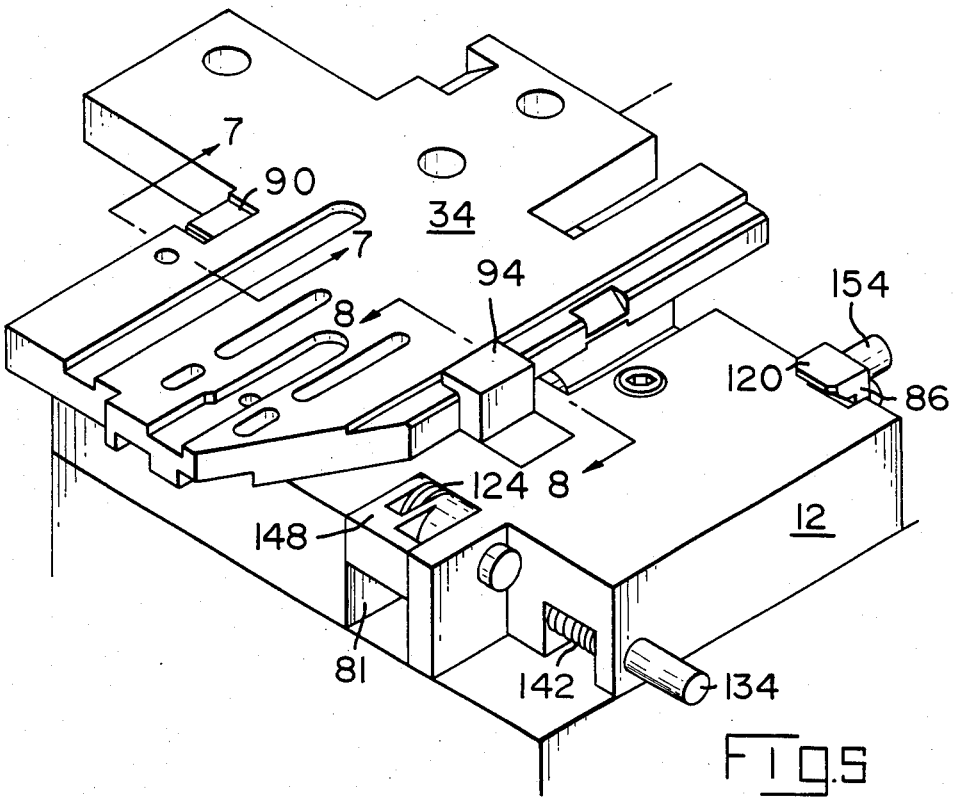
FIG. 5 is a perspective view showing the base plate of the side fed applicator locked in position upon the applicator mounting plate of the press.
Figure 6:
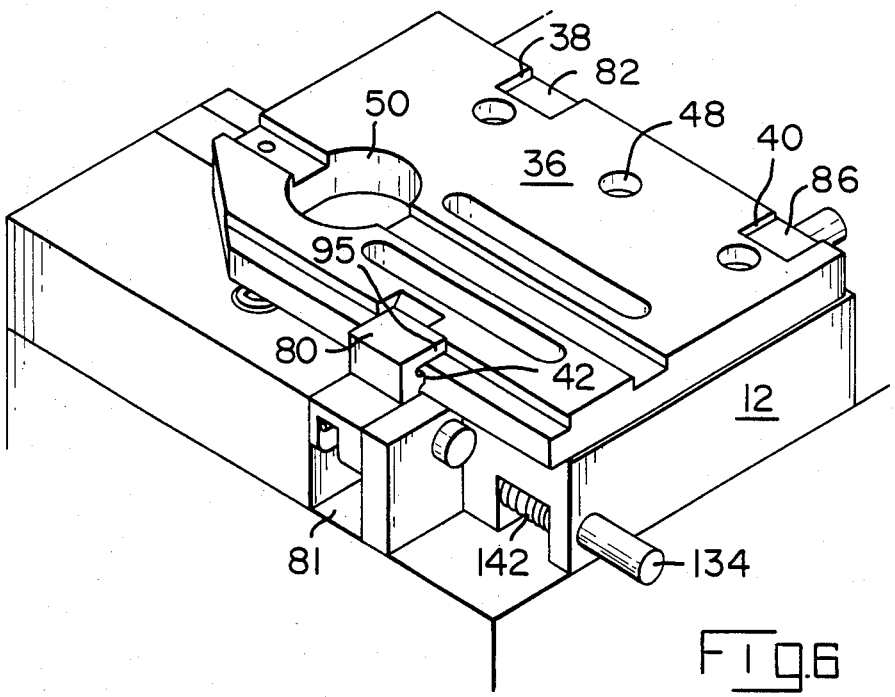
Figure 7:
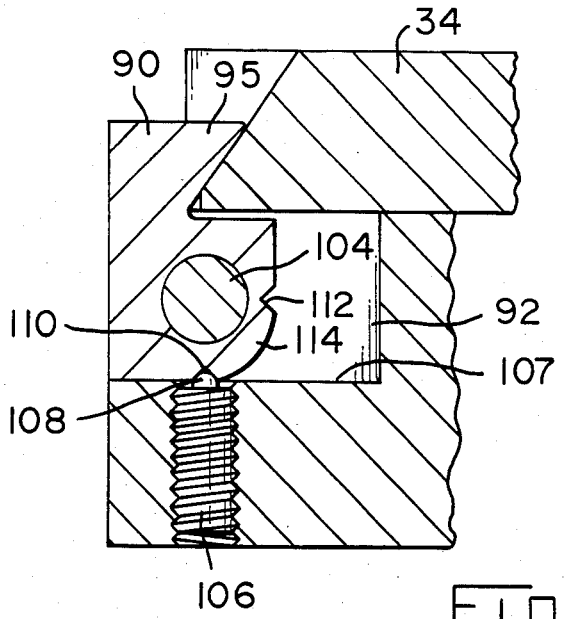
Figure 8:
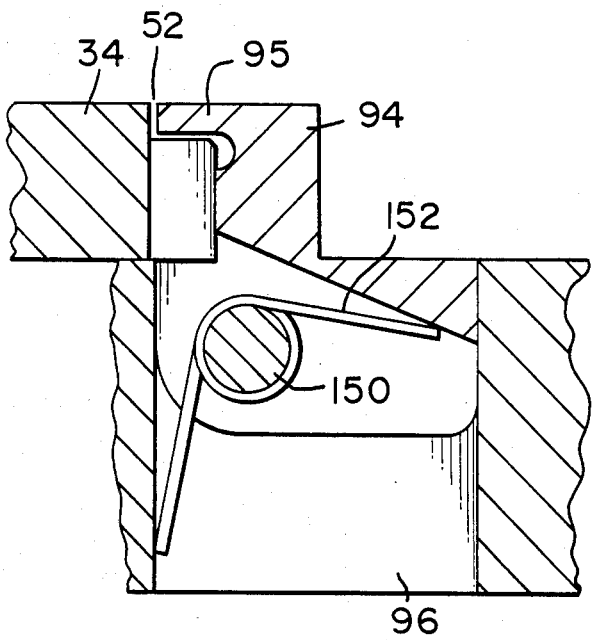

FIG. 6 is a similar view to that of FIG. 5, but showing the base plate of the end fed applicator locked in position upon the applicator mounting plate of the press; and FIGS. 7 and 8 are views taken on the lines 7—7 and 8—8, respectively, of FIG. 5.

Figure 1:
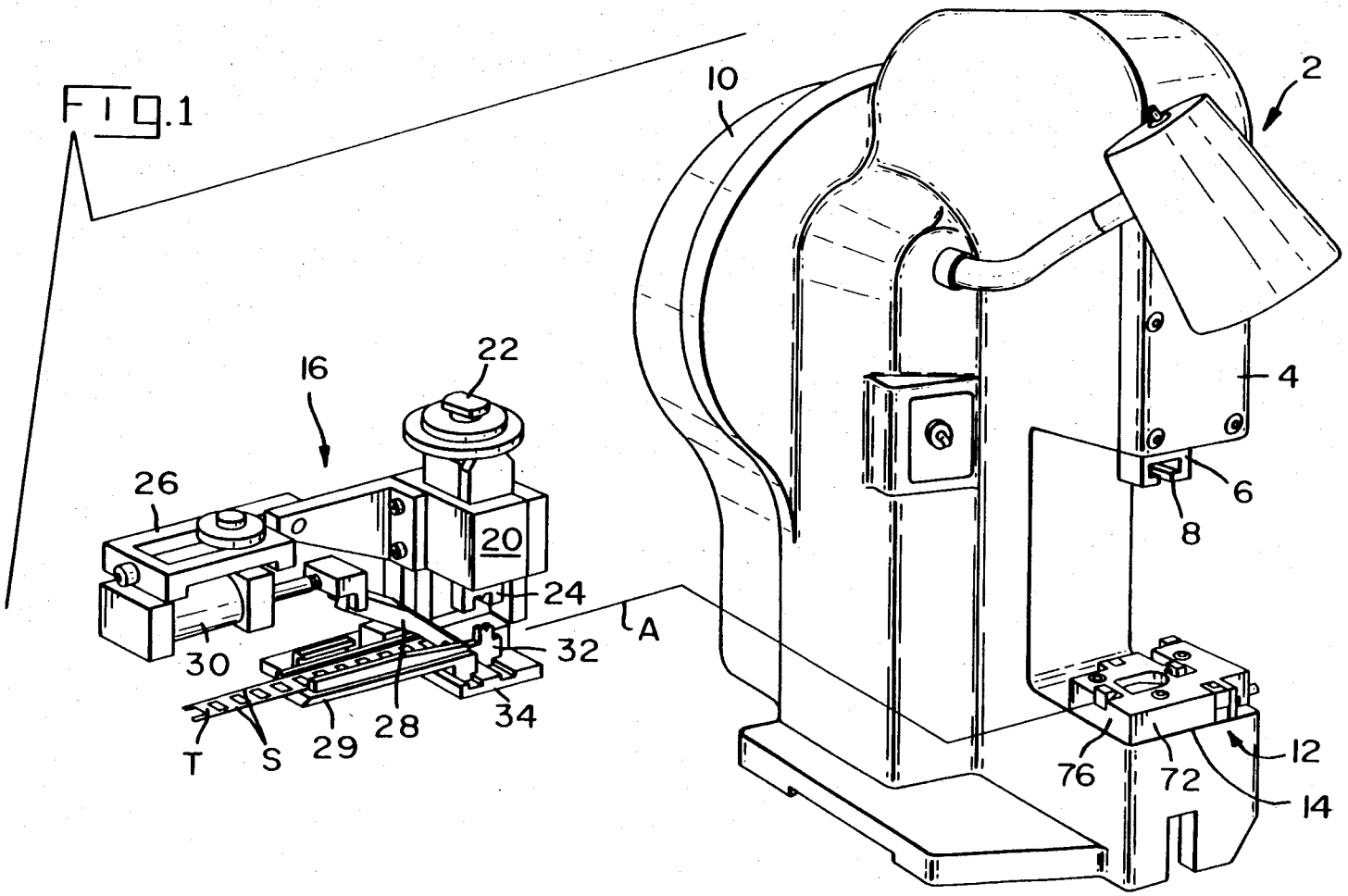
FIG. 1 is a perspective view of an electrical terminal crimping press having an applicator mounting plate, the press being shown in association with a side fed electrical terminal applicator to be mounted on the mounting plate.
Figure 1A:
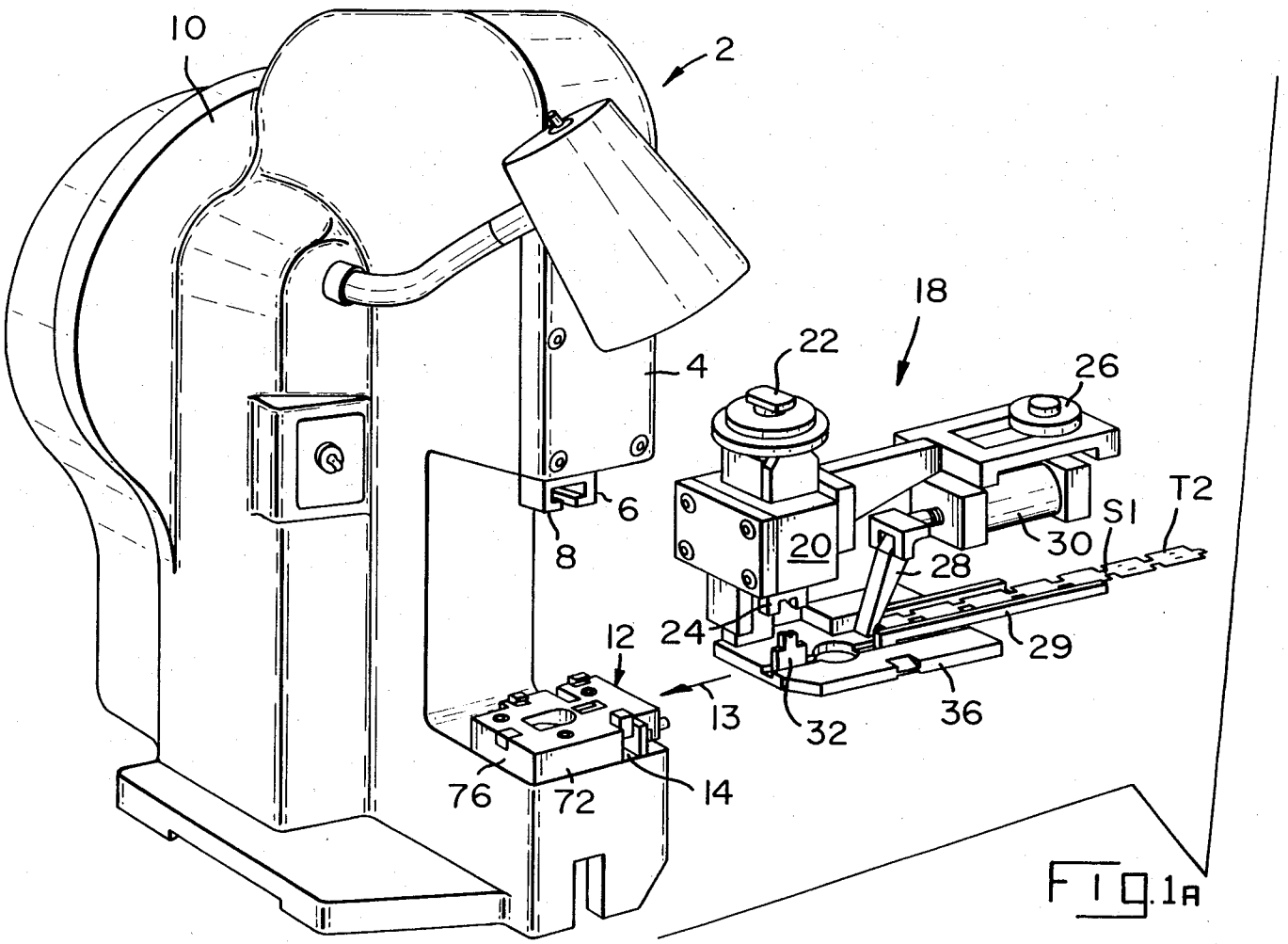
FIG. 1A is a similar view to that of FIG. 1, but in which the applicator is end fed.

As shown in FIGS. 1 and 1A, an electrical terminal crimping press 2, comprises a ram housing 4, in which is mounted for vertical sliding movement, a press ram 6 terminating in an adaptor 8, the ram 6 being drivable by a motor (not shown) through a fly wheel (not shown) in a fly wheel housing 10, and a single revolution clutch (not shown), towards and away from an electrical terminal applicator mounting plate 12 secured to a press bed 14.

There can be locked to the plate 12, in a manner to be described below, either a side fed electrical terminal applicator 16 (FIG. 1) or an end fed electrical terminal applicator 18 (FIG. 1A).

Each applicator 16 and 18 comprises a ram housing 20 containing an applicator ram terminating at its upper (as seen in FIGS. 1 and 1A) end, in an adaptor 22 for mating with the adaptor 8 of the press 2 and at its lower end in terminal crimping dies 24. Each applicator 16 and 18 has a terminal strip feeding device 26 having a feed finger 28 which can be driven in reciprocating motion by means of a piston and cylinder unit 30 to drive a strip of electrical terminals along a feed track 29 towards a terminal crimping anvil 32 to position the leading terminal of the strip thereon. Means (not shown) are also provided on the applicator ram for shearing the leading terminal of the strip, from the strip. When the applicator 16 or 18 has been locked to the plate 12, of the press 2, and the adaptor 22 of the applicator has been mated with the adaptor 8 of the press, the applicator will crimp the leading terminal to a wire (not shown) inserted between the leading terminal on the anvil 32 and the crimping dies 24 and will shear the leading terminal from the strip, upon a start switch (not shown) of the press 2 being actuated.

The press 2 and applicators 16 and 18 are of the general type described in U.S. Pat. No. 3,184,950 which is incorporated herein by reference.

The applicators 16 and 18 have base plates 34 and 36, respectively, either of which can be locked to the plate 12 of the press 2, as decribed below.

The applicator 16 is adapted for use with electrical terminals T1 which are connected together by carrier strips S in parallel relationship, whereas the applicator 18 is adapted for use with terminals T2 which are connected together in end to end relationship by means of metal slugs S1. For this reason, the respective positions in which the plates 34 and 36 must be locked to the plate 12 of the press 2 are angularly displaced from one another in a horizontal plane, by 90 degrees, so that the wires can be inserted from the front of the press, in each case as will be appreciated from FIGS. 5 and 6.

Figure 2:
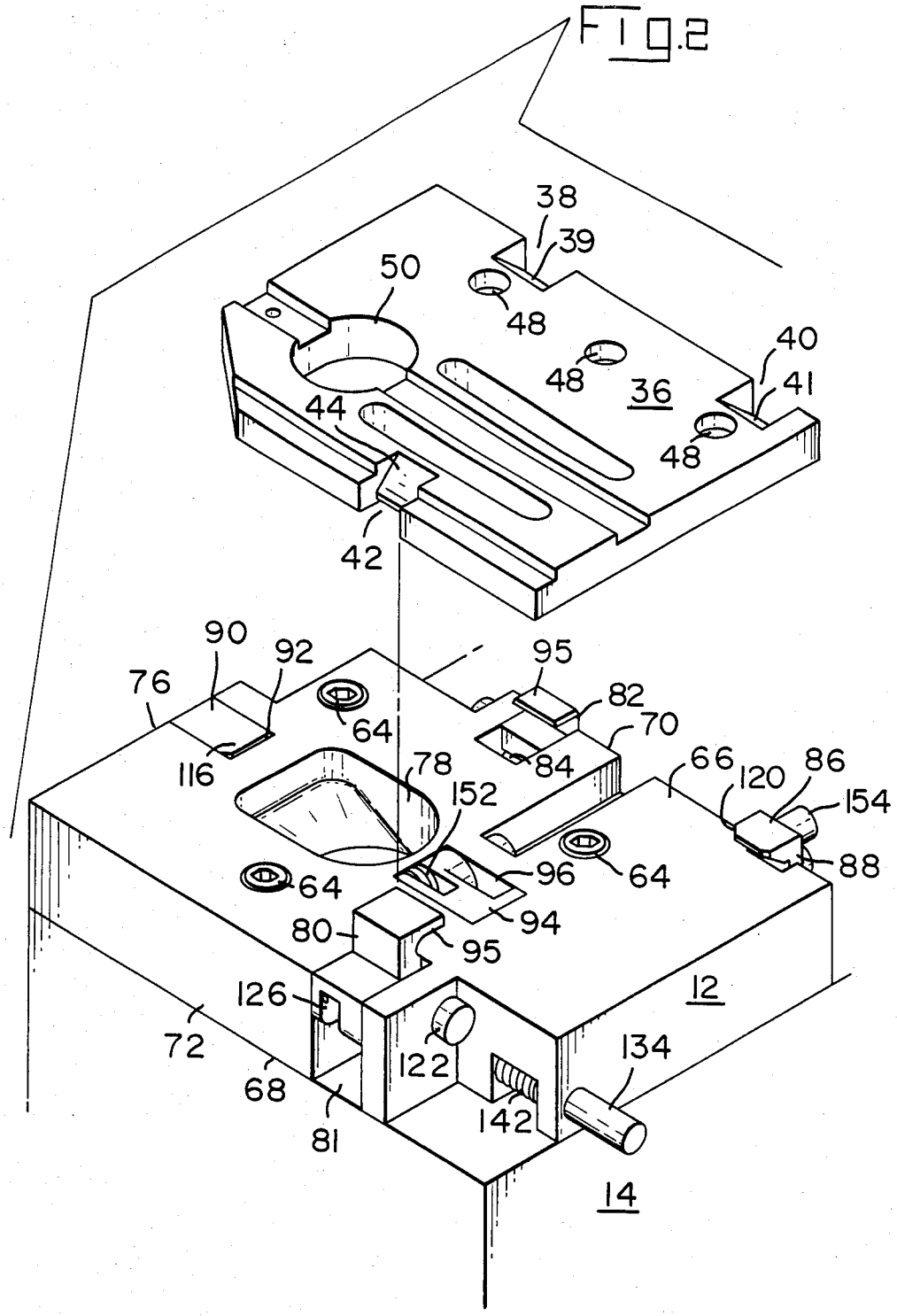
FIG. 2 is a perspective view of the applicator mounting plate of the press, in association with a base plate of the end fed applicator.

As best seen in FIG. 2, the plate 36 has formed in one edge, two notches 38 and 40 in which are ramps 39 and 41, respectively, and which are spaced longitudinally of said edge, and in its opposite edge, a substantially central notch 42 in which is a ramp 44 similar to the ramps 39 and 41. The plate 36 is also formed with bores 48 for receiving fasteners (not shown) by means of which the plate 36 is secured to the applicator 18, and a waste opening for receiving the slugs S1 when these have been sheared by the applicator 18 from the terminals T2.

Figure 4:
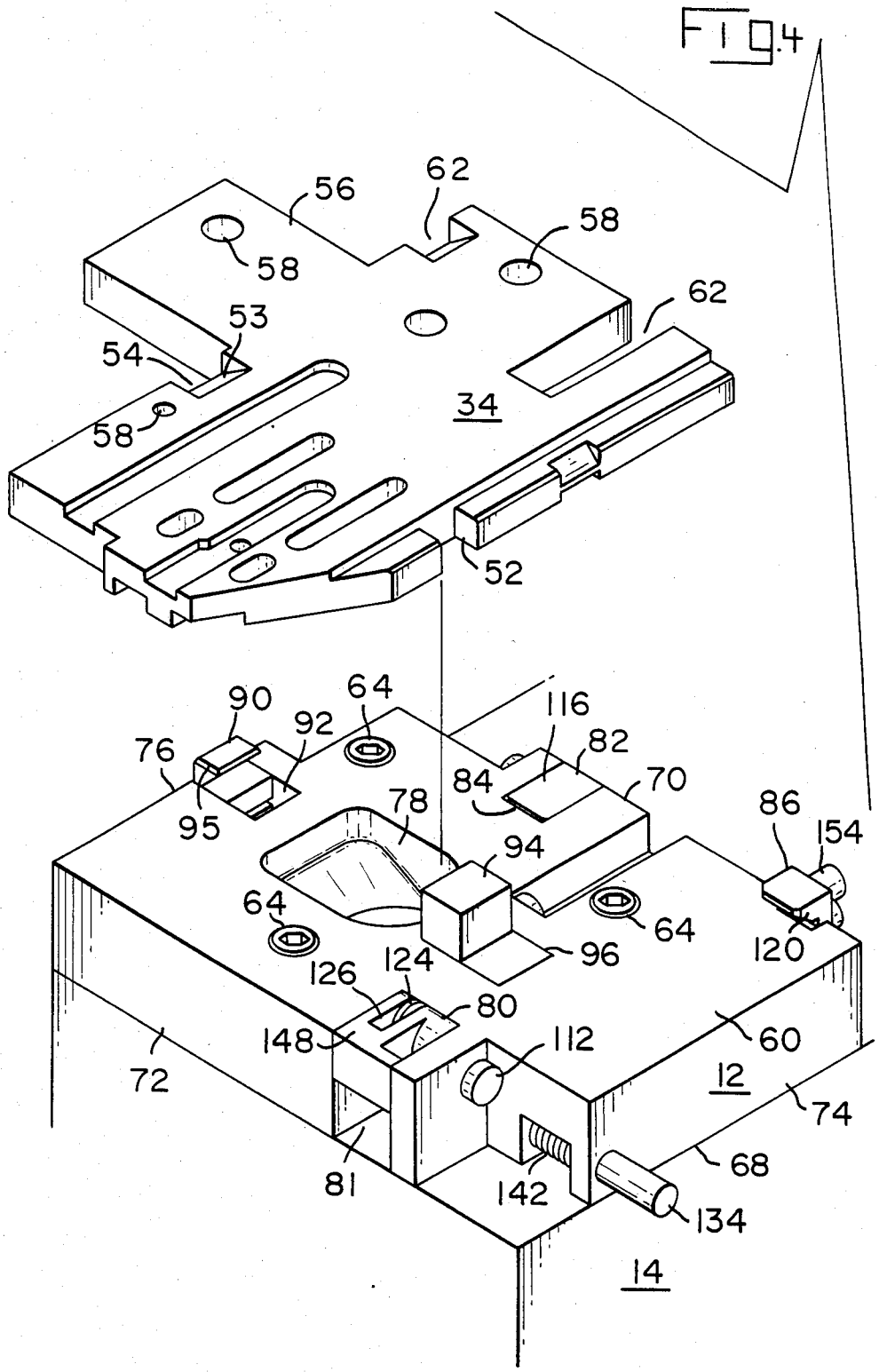
FIG. 4 is a similar view to that of FIG. 2, but showing the applicator mounting plate of the press in association with a base plate of the side fed applicator.

As best seen in FIG. 4, the plate 34 has formed in one edge, a notch 52 and in its opposite edge, a notch 54 in which is a ramp 53, and which is opposite to the notch 52. An extension 56 of the plate 34 supports the feed track 29 of the applicator 16. The plate 34 also has bores 58 for receiving fasteners securing the plate 34 to the applicator 16.

As best seen in FIGS. 2 and 4, applicator mounting plate 12 of the press 2, is secured to the press bed 14 by fasteners 64. The plate 12 has an applicator base plate supporting major side 66 which is remote from the bed 14, a major side 68 opposite to the side 66 and engaging the bed 14, opposite minor sides 70 and 72, respectively, and opposite minor sides 74 and 76, respectively.

The plate 12 is formed with a scrap chute 78 which communicates with the interior of the bed 14.

Pivotally mounted in a notch 81 in the side 72 is a latch 80 for engaging in the notch 42 of the plate 36. A latch 82 is pivotally mounted in a notch 84 in the side 70, for engagement in the notch 38 of the plate 36, a fixed gib 86 for engagement in the notch 40 in the plate 36 being mounted in a notch 88 in the side 70, proximate to the side 74. A latch 90 is pivotally mounted in a notch 92 in the wall 76, for engagement in the notch 54 of the plate 34, a latch 94 being pivotally mounted in a substantially central notch 96 in the side 66, opposite to the notch 92, for engagement in the notch 52 of the plate 34. The notch 84 lies between the notches 92 and 96.

Each of the latches 80, 82, 90, and 94 is movable between a raised latching position, and a lowered position in which the applicator supporting surface of the side 66 is uninterrupted by the latch. Each latch 80, 82, 90 and 94 has a latching lip 95 which projects over the surface of the side 66 in spaced relationship thereto in the raised position of the latch.

Figure 3:
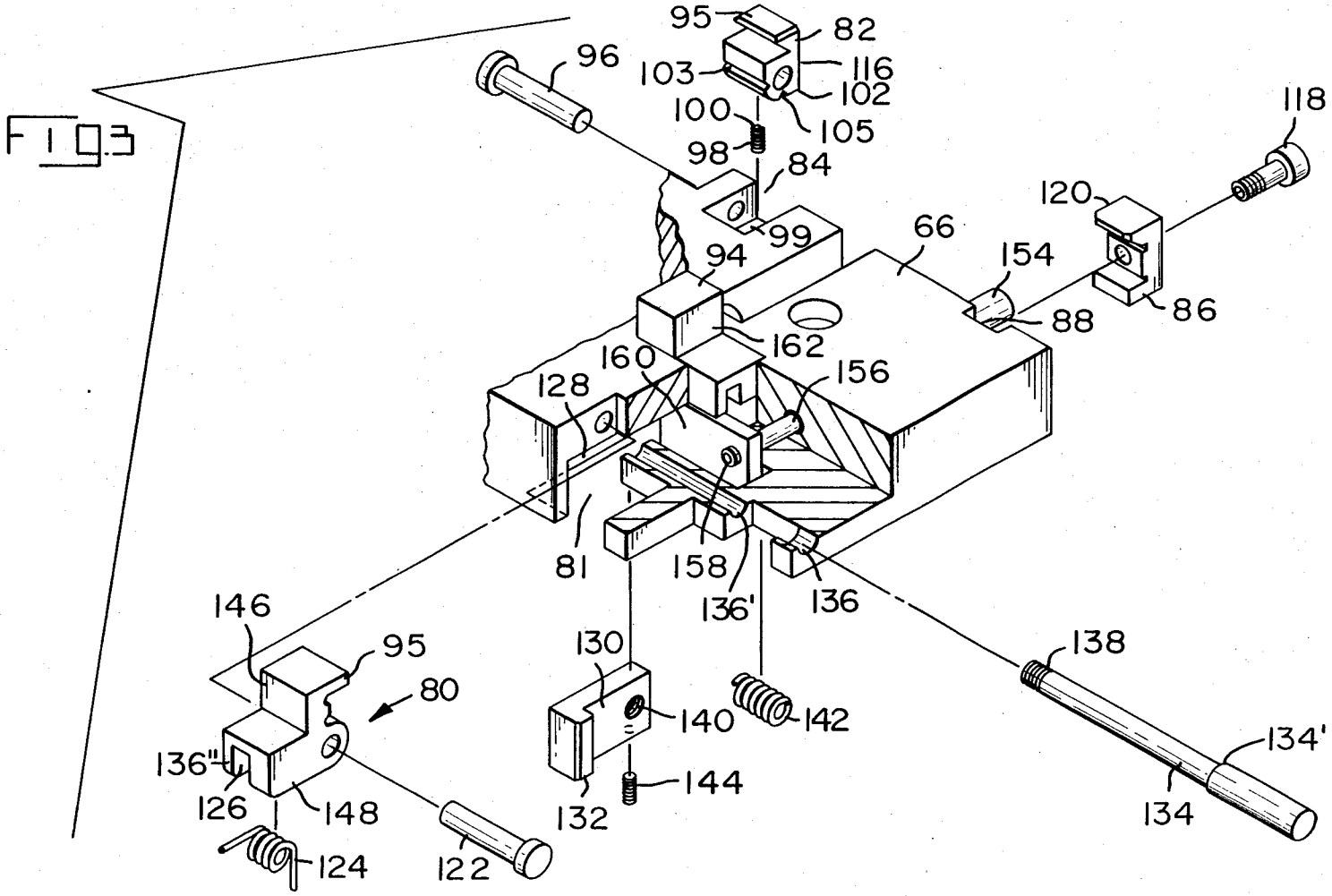
FIG. 3 is a fragmentary exploded view shown partly in section, of the applicator mounting plate.

As shown in FIG. 3, the latch 82 is mounted in the recess 84 on a pivot pin 96. A set screw 98 in the base 99 of the recess 84 has a hemispherical abutment 100 which is engageable in either of two grooves 103 or 105 in an arcuate bottom surface 102 on the latch 82. As shown in FIG. 7 the latch 90 is mounted in the recess 92 on a pivot pin 104, a set screw 106, similar to the screw 98, in the base 107 of the recess 92 having a hemispherical abutment 108 which is engageable in either of two grooves 110 or 112 in an arcuate bottom surface 114 of the latch 90. Each of the latches 82 and 90 can be moved between its raised and its lowered positions by applying finger pressure thereto. The latch 82 is retained lightly in its raised position by engagement of the abutment 100 in the notch 105 and is retained lightly in its lowered position by engagement of the abutment 100 in the notch 103. The latch 90 is retained lightly in its raised position as shown in FIG. 7, by engagement of the abutment 108 in the notch 110 and is retained lightly in its lowered position by engagement of the abutment 110 in the notch 112. In the lowered position of each latch 82 and 90, the then uppermost surface 116 (FIGS. 2 and 4) of the latch lies flush with the surface of the side 66. The gib 86 is fixedly mounted in the recess 86 by means of a screw 118 as best seen in FIG. 3, so that a lip 120 thereon projects over the surface of the side 66 in spaced relationship therewith. The latch 80 is mounted in the notch 81 on a pivot pin 122, being urged towards its raised position by a spring 124 engaged in a channel 126 in the latch 80. To the left (as seen in FIG. 3) of the notch 81 is a recess 128 in the plate 12 which can receive a latch locking member 130 having a latch engaging projection 132. A latch locking shaft 134 which is axially slidable in a bore 136 in the plate 12 has a threaded end 138 received in a tapped bore 140 in the member 130, the shaft 134 being depressable axially inwardly of the bore 136 against the action of a spring 142, to move the member 130 from a latch locking position in which its projection 132 is in the notch 81, into a latch release position in the recess 128 in which the projection 132 is withdrawn from the notch 81. The spring 142 acts between a shoulder 134' of the shaft 134 and a face 136' in the bore 136. The member 130 is secured fixedly to the shaft 134 by means of a grub screw 144. When the shaft 134 remains in its axially outer position, the projection 132 engages beneath the left-hand (as seen in FIG. 3) wall 136'' of the channel 126 in the latch 80, when the latch 80 is in its raised position (in which position it is shown in FIGS. 2, 3 and 6), so that the latch 80 cannot be lowered until the shaft 134 has been depressed inwardly of the bore 136 so that the projection 132 is withdrawn from the notch 81. The latch 80 can then be pivoted by finger pressure, against the action of the spring 124 in an anticlockwise (as seen in FIGS. 2, 3 and 6) sense. If the shaft 134 is now released, the projection 132 of the member 30 engages in a recess 146 in the latch 80, so that the latch 80 is retained in its lowered position in which its then upper surface 148 lies does not interrupt with the surface of the side 66 as shown in FIGS. 4 and 5. If the shaft 134 is now depressed again the projection 132 of the member 130 will again be withdrawn from the recess 81, thus allowing the latch 80 to be snapped into its raised position under the action of its spring 124.

The latch 94 which is pivotally mounted in the notch 96 by means of a pivot pin 150 (FIG. 8), is urged towards its raised position by a spring 152. A further latch locking shaft 154 is slidably mounted in a bore 156 in the plate 12, as shown in FIG. 3, being depressable axially inwardly of the bore 156 against the action of a spring (not shown) therein. The shaft 154 has a tapped end 158 screwed to a further latch locking member 160 which is identical with the member 130, the member 160 having a projection (not shown) which is engageable, as will be apparent from FIG. 3, with the underside of the latch 94 when in its raised position so as to retain it therein. If the shaft 154 is depressed inwardly of the bore 156, the latch member can be rotated under finger pressure, to its lowered position against the action of the spring 152, since the member 160 will have been shifted leftwardly (as seen in FIG. 3) so that its projection is clear of the latch 94. In this position, the then upper surface of the latch 94 lies flush with the surface of the side 66 of the plate 12 as shown in FIG. 2. If the shaft 154 is now released so that it is driven outwardly of the bore 156 by its spring, the projection on the member 160 will engage in a recess 162 in the latch 94 so that the latch 94 is retained in its lowered position. If the shaft 154 is now depressed again, the projection on member 160 will be cleared of the latch 94 so that the latter will be returned to its raised position by the spring 152. It will be apparent from the above description that the latch 94 is operated in the same way as the latch 80.

The shafts 134 and 154 normally extend from plate 12 so that they can readily be depressed by finger pressure.

When the applicator 16 is to be mounted on the plate 12 of the press 2, the latch 90 is moved to its raised position, the latches 80, 82 and 94 being allowed to remain in their lowered positions. The applicator 16 is then moved in the direction of the arrow A in FIG. 1 onto the side 66 of the plate 12. The position of the applicator is then adjusted so that the adaptor 22 of the applicator mates with the adaptor 8 of the press 2 and so that the ramp 53 in the notch 54 engages beneath the lip 94 of the latch 90 and the notch 52 in the plate 34 is in line with the notch 96. The shaft 154 is then depressed so that the latch 94 is snapped into its raised position by the spring 152 so that the latch 94 engages in the recess 52 whereby the applicator 16 is locked against movement relative to the plate 12. The plate 34 can be released from the plate 12 simply by depressing the shaft 54 again and moving the latch 94 back to its lowered position. The applicator 16 can then easily be detached from the plate 12.

When the applicator 18 is to be mounted on the plate 12, the latch 82 is placed in its raised position, the latches 80, 90 and 94 being allowed to remain in the lowered positions, and the applicator is moved in the direction of the arrow B in FIG. 1A, onto the plate 12. The position of the applicator 18 is then adjusted so that the adaptor 22 mates with the adaptor 8 of the press 2 and so that the latch 82 and the gib 86 enter the respective notches 38 and 40 in the plate 36 and engage the ramps 39 and 41, respectively, therein. The shaft 134 is then depressed so that the latch 80 is snapped into its raised position by the spring 124 to enter the recess 42 and to engage the ramp 44 in the recess 42, as shown in FIG. 6. The applicator 18 is thereby securely locked to the plate 12. The applicator 18 can be released from the plate 12 simply by depressing the shaft 134 and moving the latch 80 to its lowered position against the action of the spring 124, after which the applicator is moved to disengage the plate 31 from the latch 82 and the gib 86.

It will appear from the above description that the press 2 can be changed over from end feed to side feed operation or one end feed applicator or side feed applicator can be replaced by another, in a matter of seconds. At the same time, the applicator to be used is firmly locked to the plate 12.

We claim:

1. A quick change mounting plate adapted to be secured to a bed of a press, the mounting plate comprising:

a first surface to which base plates of respective end fed and side fed electrical terminal applicators are selectively lockable for operation by the press;

a second surface opposite to said first surface, for engagement with the press bed;

a first latch on one side of said first surface for engaging one edge of the base plate of said end fed applicator;

a second latch on the opposite side of said first surface for engaging the opposite edge of the base plate of said end fed applicator;

a third latch at a third side of said first surface for engaging one edge of the base plate of said side fed applicator; and a fourth latch disposed substantially centrally of said first surface for engaging the opposite edge of the base plate of said side fed applicator;

each latch being actuable manually, to move it between a raised position for engaging the respective edge of the respective base plate and a lowered position in which said first surface is uninterrupted by said latch, said fourth latch being provided with means for locking it in both its raised and its lowered positions and being urged towards its raised position by resilient means, the locking means being releasable to allow the resilient means to move said fourth latch from its raised to its lowered position with a snap action, said fourth latch being mounted for pivotal movement between its raised and its lowered positions and being urged towards its raised position by means of a spring, said locking means comprising a shaft which is slidable in a bore in the mounting plate and which carries a locking member, the shaft being movable manually between a first position in which the locking member engages beneath said fourth latch in both its lowered and its raised positions and a second position in which the locking member is clear of said fourth latch.

2. A mounting plate as claimed in claim 1, in which the shaft is urged towards its first position by means of a spring, the locking member having a projection which lies within a notch in said mounting plate in the first position of the shaft and which is retractable therefrom by moving the shaft manually to its second position.

3. A quick change mounting plate adapted to be secured to a bed of a press, the mounting plate comprising:

a first surface to which base plates of respective end fed and side fed electrical terminal applicators are selectively lockable for operation by the press;

a second surface opposite to said first surface, for engagement with the press bed;

a first latch on one side of said first surface for engaging one edge of the base plate of said end fed applicator;

a second latch on the opposite side of said first surface for engaging the opposite side of the base plate of said end fed applicator;

a third latch at a third side of said first surface for engaging one edge of the base plate of said side fed applicator; and a fourth latch disposed substantially centrally of said first surface for engaging the opposite edge of the base plate of said side fed applicator;

each latch being actuable manually, to move it between a raised position for engaging the respective edge of the respective base plate and a lowered position in which said first surface is uninterrupted by said latch, in which said third latch has a latching lip which lies above said first surface and in spaced relationship thereto when the third latch is in its raised position, said third latch having an arcuate surface facing the base of a notch in said mounting plate, in which said third latch is accommodated, a pair of angularly spaced grooves being formed in said arcuate surface, a pivot pin in the mounting plate passing through a bore in said third latch which bore extends between the latching lip and said arcuate surface, an abutment in the base of said notch being releasably engaged in one of said grooves, in the raised position of the third latch, and in the other groove in the lowered position of the third latch.

4. A quick change mounting plate adapted to be secured to a bed of a press, the mounting plate comprising:

a first surface to which base plates of respective end fed and side fed electrical terminal applicators are selectively lockable for operation by the press;

a second surface opposite to said first surface, for engagement with the press bed;

a first latch on one side of said first surface for engaging one edge of the base plate of said end fed applicator;

a second latch on the opposite side of said first surface for engaging the opposite side of the base plate of said end fed applicator;

a third latch at a third side of said first surface for engaging one edge of the base plate of said side fed applicator; and a fourth latch disposed substantially centrally of said first surface for engaging the opposite edge of the base plate of said side fed applicator;

each latch being actuable manually, to move it between a raised position for engaging the respective edge of the respective base plate and a lowered position in which said first surface is uninterrupted by said latch, in which said first and fourth latches are urged towards their raised positions by resilient means, means being provided for releasably locking said first and fourth latches in their lowered positions, said locking means being manually operable to release said first and fourth latches for movement from their lowered positions towards their raised positions, under the action of said resilient means, and in which each locking means comprises a shaft which is slidably mounted in a bore in the mounting plate, the shafts extending at right angles to one another, each shaft carrying a locking locking member and being urged by a spring towards a first locking position in which the locking member engages its respective latch, each shaft being slidable against the action of its spring, into a second, release position, in which the locking member is clear of said respective latch.

5. A mounting plate as claimed in claim 4, in which a gib is fixed mounted on said opposite side of said first surface for engaging said opposite edge of the base plate of said end fed applicator.

6. A mounting plate as claimed in claim 4, in which each latch is pivotally mounted in a notch in the mounting plate.

* * * * *

UNITED STATES PATENT OFFICE

CERTIFICATE OF CORRECTION

Patent No. 4,611,484 Dated September 16, 1986

Inventor(s) William M. Kissinger, Jr., et al.

It is certified that error appears in the above-identified patent and that said Letters Patent are hereby corrected as shown below:

In Section 19 on the front page of the specification, delete "MacKissinger" and insert --- Kissinger ---.

In claim 4, column 7, line 28, delete "side" and insert --- edge ---.

Signed and Sealed this

Twenty-fifth Day of November, 1986

*Attest:*

DONALD J. QUIGG

*Attesting Officer* *Commissioner of Patents and Trademarks*